US011607021B2

(12) United States Patent
Haythornthwaite

(10) Patent No.: US 11,607,021 B2
(45) **Date of Patent: *Mar. 21, 2023**

(54) UMBRELLA HAVING ANTI-INVERSION MECHANISM

(71) Applicant: Shedrain Corporation, Portland, OR (US)

(72) Inventor: David Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/231,408

(22) Filed: Apr. 15, 2021

(65) Prior Publication Data

US 2021/0227941 A1 Jul. 29, 2021

Related U.S. Application Data

(63) Continuation of application No. 16/838,388, filed on Apr. 2, 2020, now Pat. No. 11,006,711, which is a continuation-in-part of application No. 16/662,435, filed on Oct. 24, 2019, now abandoned.

(60) Provisional application No. 62/749,852, filed on Oct. 24, 2018.

(51) Int. Cl.

| | |
|---|---|
| ***A45B 25/22*** | (2006.01) |
| ***A45B 19/10*** | (2006.01) |
| *A45B 25/18* | (2006.01) |
| *A45B 25/06* | (2006.01) |
| *A45B 19/00* | (2006.01) |

(52) U.S. Cl.
CPC ..... *A45B 25/22* (2013.01); *A45B 19/10* (2013.01); *A45B 25/06* (2013.01); *A45B 25/18* (2013.01); *A45B 2019/004* (2013.01)

(58) Field of Classification Search
CPC ..... A45B 25/22; A45B 25/18
See application file for complete search history.

(56) References Cited

U.S. PATENT DOCUMENTS

| | | | |
|---|---|---|---|
| 559,577 | A | 5/1896 | Hadfield |
| 1,104,598 | A | 7/1914 | Wyskosky |
| 1,444,017 | A | 2/1923 | Waschek |
| 2,616,439 | A | 11/1952 | Thompson |

(Continued)

FOREIGN PATENT DOCUMENTS

| | | |
|---|---|---|
| CN | 203152755 | 8/2013 |
| CN | 207306272 | 5/2018 |

(Continued)

*Primary Examiner* — Noah Chandler Hawk
(74) *Attorney, Agent, or Firm* — Leason Ellis LLP

(57) ABSTRACT

An umbrella includes an anti-inversion mechanism that is configured to apply to each rib assembly a force that counters an inversion force that is applied to the umbrella. The anti-inversion mechanism includes a first elongated member that is coupled at a first end to one rib of the plurality of ribs. The umbrella also includes a second elongated member having a first end coupled to the first elongated member. A first connector is coupled to a distal end of the distal rib; and a second connector is coupled to a second end of the first elongated member. The first connector and the second connector are coupled to one another to securely attach the second elongated member to the distal rib.

19 Claims, 8 Drawing Sheets

(56) References Cited

U.S. PATENT DOCUMENTS

| | | | |
|---|---|---|---|
| 2,833,297 | A | 5/1958 | Tibony |
| 4,456,023 | A | 6/1984 | Fujihashi |
| 4,779,896 | A | 10/1988 | Ingalls |
| 5,305,771 | A | 4/1994 | Wilk |
| 5,720,311 | A | 2/1998 | Lin et al. |
| 5,791,359 | A | 8/1998 | Lin |
| 5,842,493 | A | 12/1998 | Yakubisin |
| 6,016,822 | A | 1/2000 | Lin |
| 6,058,952 | A | 5/2000 | Lin et al. |
| 6,089,244 | A | 7/2000 | Ko |
| 6,112,755 | A | 9/2000 | Lin |
| 6,186,157 | B1 | 2/2001 | Lin et al. |
| 6,338,353 | B1 | 1/2002 | Chen |
| 6,343,568 | B1 | 2/2002 | McClasky |
| 6,360,759 | B1 | 3/2002 | Lin et al. |
| 6,497,242 | B1 | 12/2002 | Lin et al. |
| 6,588,439 | B2 | 7/2003 | Wu |
| 6,863,081 | B2 | 3/2005 | Hsieh |
| 6,948,506 | B2 | 9/2005 | Wang |
| 7,415,986 | B2 | 8/2008 | Wu |
| 7,527,063 | B1 | 5/2009 | Chen |
| 7,588,042 | B2 | 9/2009 | Chang |
| 9,301,582 | B2 | 4/2016 | Haythornthwaite et al. |
| 9,486,044 | B1 | 11/2016 | Dai |
| 9,609,926 | B2 | 4/2017 | Haythornthwaite et al. |
| 9,629,426 | B1 * | 4/2017 | Dai ..... A45B 19/10 |
| 9,788,617 | B1 | 10/2017 | Chen |
| 9,839,268 | B2 | 12/2017 | Chen |
| 10,258,120 | B2 | 4/2019 | Crayton |
| 10,716,372 | B1 | 7/2020 | Li |
| 11,006,711 | B2 | 5/2021 | Haythornthwaite |
| 2002/0157695 | A1 | 10/2002 | Hsieh |
| 2003/0005951 | A1 | 1/2003 | Wu |
| 2003/0029485 | A1 | 2/2003 | Johnson et al. |
| 2004/0149326 | A1 | 8/2004 | Hsieh |
| 2004/0238020 | A1 | 12/2004 | Lee |
| 2005/0236024 | A1 | 10/2005 | Wu |
| 2008/0149153 | A1 | 6/2008 | Chang |
| 2011/0108074 | A1 | 5/2011 | You |
| 2013/0228203 | A1 | 9/2013 | David |
| 2015/0096601 | A1 | 4/2015 | Haythornthwaite et al. |
| 2016/0135555 | A1 | 5/2016 | Haythornthwaite |
| 2017/0196324 | A1 | 7/2017 | Haythornthwaite et al. |
| 2017/0215535 | A1 | 8/2017 | Chen et al. |
| 2020/0128930 | A1 | 4/2020 | Haythornthwaite |

FOREIGN PATENT DOCUMENTS

| | | |
|---|---|---|
| FR | 2844430 | 3/2004 |
| GB | 2120547 | 12/1983 |
| GB | 2425254 | 10/2006 |
| JP | S51-127333 | 11/1976 |
| JP | H06-105708 | 4/1994 |
| JP | 3007819 | 2/1995 |
| JP | H10-179223 | 7/1998 |
| JP | 2002-101931 | 4/2002 |
| JP | 2002336018 | 11/2002 |
| KR | 200439380 | 4/2008 |
| KR | 20110005299 | 5/2011 |

* cited by examiner

UMBRELLA HAVING ANTI-INVERSION MECHANISM

CROSS-REFERENCE TO RELATED PATENT APPLICATIONS

This application is a continuation of U.S. patent application Ser. No. 16/838,388, filed Apr. 2, 2020, which is a continuation-in-part of U.S. patent application Ser. No. 16/662,435, filed Oct. 24, 2019, which is based on and claims priority to U.S. Provisional Patent Application 62/749,852, filed Oct. 24, 2018, the entire contents of each application is incorporated by reference herein as if expressly set forth in its respective entirety herein.

TECHNICAL FIELD

The present invention relates to umbrellas and more particularly, relates to an umbrella rib assembly having an anti-inversion feature.

BACKGROUND

As is well known, an umbrella is a device that protects the user from the elements and in particular from liquid and frozen precipitation or even the sun, etc. A traditional umbrella has the following parts: a pole, a canopy, ribs, a runner, springs and a ferrule. A pole is the metal or wooden shaft that runs between the umbrella's handle at the bottom (or the base stand in the case of a patio model) and the canopy at the top. The canopy is the fabric part of the umbrella that catches the rain, the wind and the sun. The ribs are what give an umbrella its structure and shape. Outer ribs hold up the canopy and inner ribs (sometimes called stretchers) act as supports and connect the outer ribs to the umbrella pole. A runner slides up and down the pole while connected to the ribs/stretchers, and is responsible for the opening and closing of the canopy. Many umbrella designs include a top spring to hold the runner up when the canopy is open, a bottom spring to hold the runner down when the canopy is closed, and sometimes a center ball spring to extend the pole length in telescopic models. Strictly ornamental, the finial (also called the ferrule) is found on the very top of the umbrella, above the canopy.

Umbrella ribs function in a folding construction supporting the umbrella canopy fabric. Under normal operating conditions, the forces acting on the umbrella canopy fabric increase toward peak values when the canopy becomes fully deployed and when wind gusts tend to overturn the canopy. These forces are transmitted from the canopy to the canopy ribs, and can act on the ribs in opposite directions depending on the direction of the wind. The ribs thus have to be strong enough to withstand forces which can act on them from anyone of the two main opposite directions.

In addition to their strength requirements, the shape of the umbrella ribs should change between a substantially straight contour when the umbrella is folded and a curved one, when the canopy if fully deployed. The straight design is aimed to allow the folded fibs to lay parallel to the shaft of the umbrella when the umbrella is folded and the curved design provides for the typical mushroom-like shape (also called bell shaped).

SUMMARY

In one aspect of the present disclosure, an umbrella is provided and includes an elongated shaft having a first end and an opposite second end and a runner slidably disposed about the elongated shaft. The umbrella includes a plurality of rib assemblies, with each rib assembly including a first rib part, a second rib part and a third rib part. The rib assembly is attached to the runner by a strut that moves between open and closed positions in which in the open position, the first, second and third rib parts are in an open, extended position and in the closed position, the first, second and third rib parts are in a closed, collapsed position.

The umbrella further includes an anti-inversion mechanism that is configured to apply to each rib assembly a force that counters an inversion force that is applied to the umbrella. The anti-inversion mechanism includes a flexible elongated structure that is disposed exteriorly along the second rib part and has a first bent end that is attached to the second rib part by passing through an opening formed in the second rib part and being anchored within a hollow interior of the second rib part. The mechanism further includes a flexible wire having a first end attached to the flexible elongated structure of the anti-inversion mechanism and a second end attached to a rib tip that is located at a free distal end of the rib assembly.

In one implementation, the umbrella includes an elongated shaft having a first end and an opposite second end and a runner slidably disposed about the elongated shaft. The umbrella includes a plurality of rib assemblies. Each rib assembly includes a plurality of ribs including a distal rib. The rib assembly is attached to the runner by a strut that moves between open and closed positions in which in the open position the plurality of ribs are in an open, extended position and in the closed position, the plurality of ribs are in a closed, collapsed position. The umbrella includes an anti-inversion mechanism that is configured to apply to each rib assembly a force that counters an inversion force that is applied to the umbrella. The anti-inversion mechanism includes a first elongated member (e.g., a metal wire) that is coupled at a first end to one rib of the plurality of ribs. The umbrella also includes a second elongated member (e.g., a string) having a first end coupled to the first elongated member. A first connector is coupled to a distal end of the distal rib; and a second connector is coupled to a second end of the first elongated member, wherein the first connector and the second connector are coupled to one another to securely attach the second elongated member to the distal rib.

BRIEF DESCRIPTION OF THE DRAWING FIGURES

DETAILED DESCRIPTION OF CERTAIN EMBODIMENTS

As discussed herein, the present invention is directed to improvement with respect to a number of components of an umbrella including but not limited to a shaft construction and a rib assembly thereof. As discussed herein, the features of the present invention can be implemented with both a manual type umbrella and an automatic type umbrella. In addition, the other features can be implemented with other types of umbrellas. Accordingly, the following discussion and figures describe exemplary embodiments that implement the teachings of the present invention.

Figure 1:
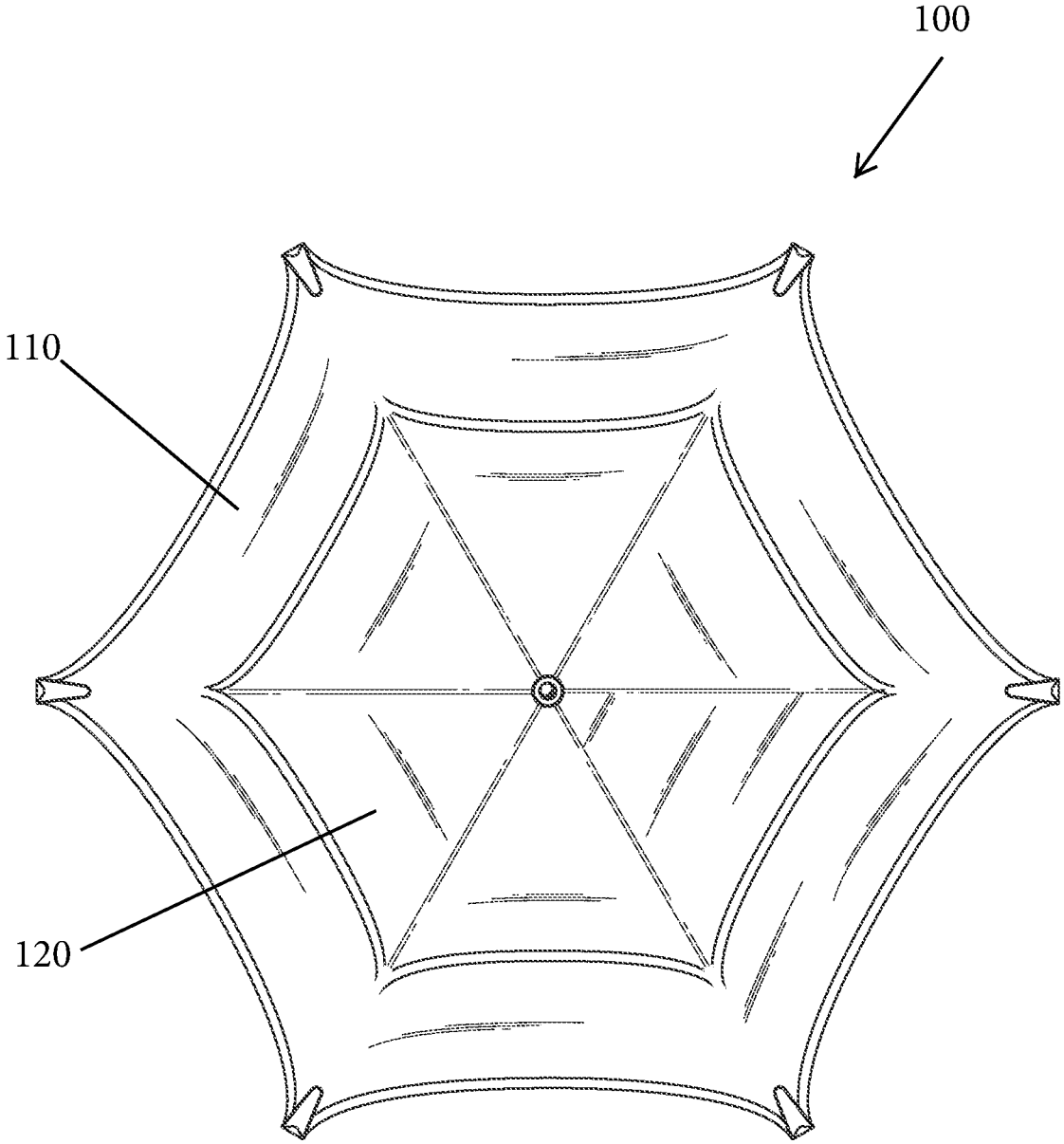
FIG. 1 is a top plan view of an exemplary dual canopy umbrella in accordance with the present invention.
Figure 2:
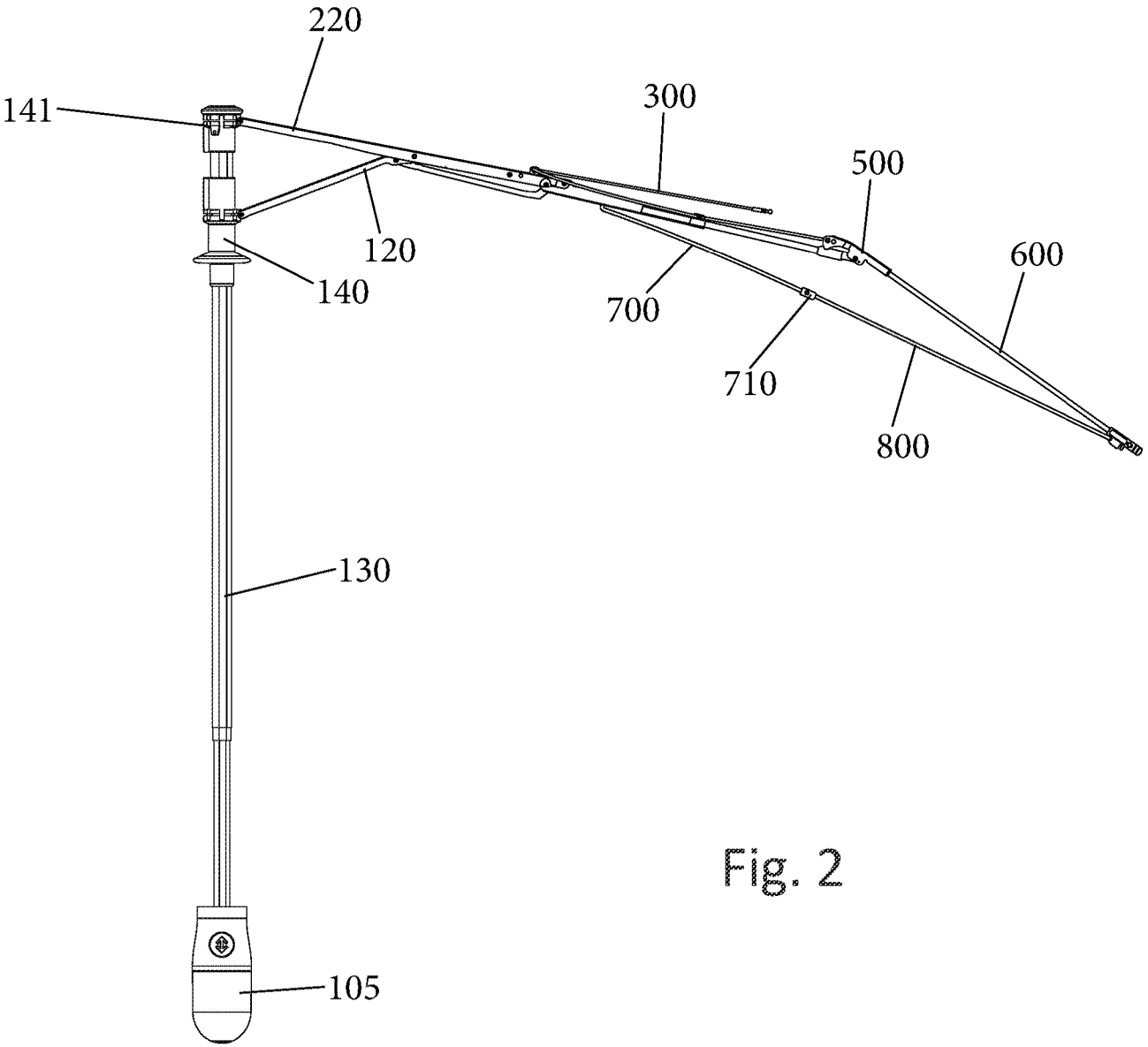
FIG. 2 is a side elevation view of a shaft, runner and rib assembly with an anti-inversion mechanism without the canopies being shown and being shown in an extended position.
Figure 4:
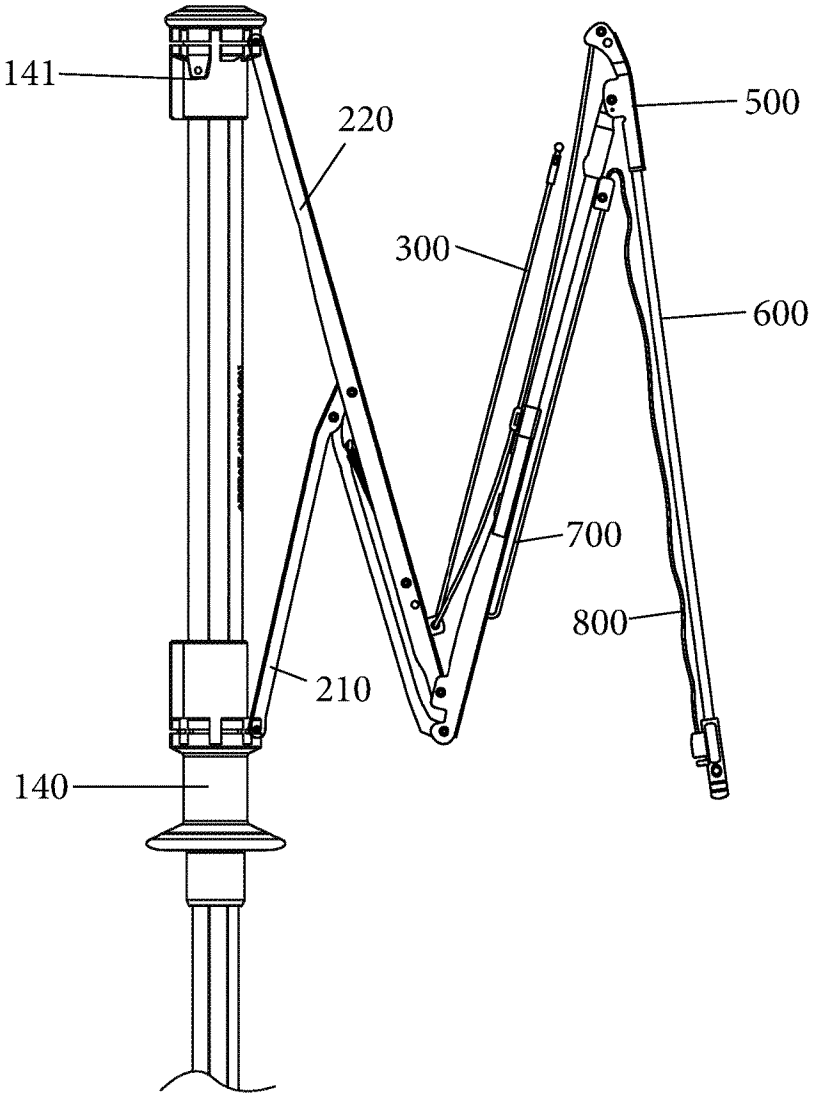
FIG. 4 is a close-up view showing the runner and rib assembly in the partially closed position.
Figure 3:
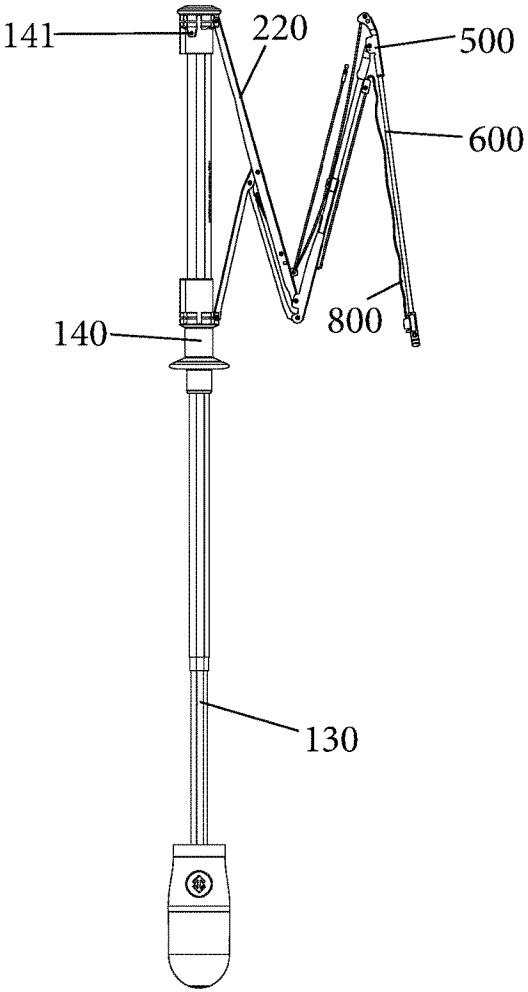
FIG. 3 is a side elevation view showing the runner and rib assembly in a partially closed position.

FIG. 1 shows a top plan view of an umbrella 100 in accordance with one exemplary embodiment of the present invention with multiple rib assemblies being shown and FIG. 2 is a side elevation view showing the umbrella 100 without the canopy. The umbrella 100 includes a shaft 130 that has a first (top) end and an opposite second (bottom) end. The shaft 130 itself can be formed of any number of different components to cooperate to provide shaft 130 and the shaft 130 illustrated in FIG. 2 is part of a manual umbrella assembly in which the user manually opens and closes the umbrella. At the first end of the shaft, a cap 141 can be provided to close off the shaft 130 and at the second end, a handle 105 is provided for grasping by the user. A movable runner 140 is provided along the shaft 130.

The umbrella 100 can be of a dual canopy design in that there is a first canopy 110 that acts as the main canopy and a second canopy 120 that acts as a secondary canopy. Both the first canopy 110 and the second canopy 120 are anchored to the cap at the top of the shaft along their innermost portions, with the second canopy 120 also be attached about its periphery at select locations to the first canopy 110 as described herein. It will be appreciated that the shape and size of the illustrated canopies are only exemplary and not limiting of the present invention. Thus, FIG. 1 shows just one exemplary dual canopy design and is not limiting. The outer periphery of the second canopy 120 can be disposed along the bottom surface of the first canopy 110 and as is known in the art, the first canopy can thus have a center open which is covered by the second canopy but the dual canopy design acts as a vent since the seam between the two canopies is open at select locations to allow venting.

The first canopy 110 has a large center opening over which the second canopy 120 is disposed so as to define a vent between the two canopies and the peripheral outer edge of the second canopy 120 overlies the first canopy 110.

The umbrella 100 includes a plurality of rib assemblies that are coupled to both the cap and the runner 140 and this results in the opening and closing of the rib assembly 200 and the attached canopy (not shown) based on the direction of movement of the runner 140. As described herein, each rib assembly is defined by a number of rib parts that are pivotally attached to another to allow for the collapsing and extension of the rib assembly in response to opening and closing of the canopy by the runner 140.

The connection between the rib assembly and the runner 140 is made by a first strut 210. The strut 210 is an elongated structure that has a first end 212 and an opposite second end 214, with the second end 214 being pivotally attached to the rib assembly, as discussed herein, and the first end 212 being pivotally attached to the runner 140. The pivotal connection between the first strut 210 and the runner 140 and between the first strut 210 and the rib assembly can be accomplished with a fastener, such as a rivet or pin, etc. More specifically, a first strut joint (first connection point/pivot) 225 is formed between the first strut 210 and the rib assembly at second end 214 and a similar strut joint can be formed between the first strut 210 and the runner 140 at the first end 212.

The first strut 210 can be formed of any number of different materials including a metal (e.g., a zinc alloy).

As shown in FIGS. 2-6, the rib assembly can be formed of a number of elongated rib components (parts) that are coupled to one another and to other components of the umbrella to provide a rib assembly that opens and closes. In the illustrated embodiment, each rib assembly includes a plurality of rib parts and more particularly, the rib assembly includes three distinct rib parts, namely, a first rib part 220, a second rib part 400, and a third rib part 600.

The first rib part 220 includes a first end 222 and an opposing second end 224; the second rib part 400 includes a first end 410 and an opposing second end 413; and the third rib part 600 includes a first end 602 and an opposing second end 604.

The attachments between the rib parts 220, 400, 600 are of a pivotal nature to allow the rib assembly 200 to both open and close. More specifically and as described herein, a pivotal joint or the like can be provided between the respective parts to allow the desired rib action when the rib assembly both opens (expands) and closes (collapses).

The first end 222 of the first rib part 220 is pivotally connected to the top cap and the second end 224 is connected to the first end 410 of the second rib part 400 at a pivot joint (pivot point) 414. This pivot joint allows the first rib part 220 and second rib part 400 to pivot between a fully closed position and a fully opened position.

A second strut 230 is also provided and extends between the first strut 210 and the second rib part 400. More specifically, the second strut 230 has a first end 232 and an opposing second end 234. The first end 232 is pivotally attached to the second end 214 of the first strut 210 at a pivot 215. The second end 234 is pivotally attached to the first end 410 of the second rib part 400 at a pivot 412. Along a top surface of the second strut 230 at or near the first end 232, the second strut 230 has a coupling member 242 that can be in the form of a hook or the like. The hook 242 faces the first rib part 220.

A biasing member 240 is biasedly attached between the second strut 230 and the first rib part 220. The biasing member 240 can comprise an elongated spring that is attached at its first end to the hook 242 and is attached at its second end to the first rib part 220 at a connection point 244. The first rib part 220 can have a C-shaped cross-section and therefore there is a center channel into which the biasing member 240 can be received as shown in FIGS. 2-6. The biasing member 240 thus applies a biasing force to the second strut 230 and the first rib part 220. In particular, when the umbrella 100 is being closed, the biasing member 240 can act to draw the second strut 230 toward the first rib part 220.

Along a top surface of the first rib part 220 there is a coupling member 247. The coupling member 247 can be in the form of an eyelet.

As mentioned, the first end 410 of the second rib part 400 is pivotally attached to both the first rib part 220 and the second strut 230 and the second end 413 is pivotally attached to a rib joint member 500 as described in more detail below. The second rib part 400 can also have a C-shaped cross-section and thus have a central channel formed therein.

The rib joint member 500 has a first end 502 and a second end 504. The rib joint member 500 has two defined pivotal attachment regions and more particularly, at a first end 502, a first attachment region is defined, while at a second attachment region, the second end 413 is pivotally attached to this second attachment region of the rib joint member 500. The second end 504 of the rib joint member 500 can have a tubular structure to allow receipt of the third rib part 600. The third rib part 600 can have a cylindrical shape and can be in the form of a flexible metal rod. The first end 602 of the third rib part 600 is attached to the second end 504 as by being received within an opening at the second end 504 and then fixedly attached thereto as by using any number of conventional techniques, including bonding, etc.

Unlike the first rib part 220 and the second rib part 400 which both have C-shaped cross-sections and can be formed of metal, the third rib part 600 is more flexible and has a solid structure, such as a cylindrical rod. At the second end 604 of the third rib part 600, a rib tip 610 is provided. The rib tip 610 can be a metal part to which the peripheral edge of the main first canopy 110 is attached. For example, a hole can be formed through the rib tip 610 through which a portion of the first canopy 110 can extend. The rib tip 610 also includes a protrusion 612 that extends along a section of the lower surface of the rib tip 610. The protrusion 612 is preferably formed of the same material as the rib tip 610 since it is integrally formed and has a hollow construction.

The anti-inversion mechanism of the present invention includes a first wire member that has a first wire portion 300 (wire coupling member for the inner canopy), a second wire portion 310, a second wire member 700 and a third wire member 800.

The first wire member comprises a bent wire structure that is bent so to form a first wire portion 300 and a second wire portion 310 that are extend along one another such that the two free ends of the first wire member are proximate one another since the wire member is bent over itself. The first wire member is passed through the coupling member 247 (eyelet) so as to secure the first wire member to the first rib member 220.

The second wire portion 310 is coupled to the second rib member 400 by a coupling member 415 that is located along the top surface of the second rib member 400. The coupling member 415 can be in the form of a clip or eyelet to which the second wire portion 310 is attached (i.e., the second wire portion 310 extends through a hole in the coupling member 415.

The free end of the first wire portion 300 includes a tip member 302, such as a metal tip member, while the free end of the second wire portion 310 is attached to the rib joint member 500 at pivot 312 at first end 502. As described below, the first end portion 300 is coupled to the secondary canopy 120 as provides a means for preventing inversion of the secondary canopy 120.

The second wire member 700 is an elongated wire (e.g., a metal rod) that has a first end 702 and an opposite second end. The first end 702 can be a bent end that is anchored to the second rib part 400 as by being passed through a bottom of the second rib part 400 into the central channel defined within the second rib part 400 and then fixedly attached therein as by a rivet or the like. The second wire member 700 is only anchored at its first end 702 and thus represents a cantilevered, flexible structure that flexes under applied forces as described herein. The second wire member 700 can be a metal wire (e.g., a metal rod) that is rigid and maintains its form under normal operating conditions. As discussed herein, the third wire member 800 has a much different form in that it more represents a thin wire or metal string that can be readily bent and readily assumes a non-linear shape during normal use. The third wire member 800 has much less rigidity than the second wire member 700 which under normal use maintains it elongated, linear form except for the purposely bent end 702. The third wire member 800 can also be formed of a synthetic (polymer) material, such as a polymeric wire, cable or string, etc.

At the free end of the second wire member 700, a connector 710 is provided and can be pivotally attached to the free end of the second wire member 700 as by a rivet or the like. The connector 710 can be a plastic hollow structure into which the free end of the second wire member 700 is received. The connector 710 is also attached to the third wire member 800 which is much more flexible and thinner that the rigid metal second wire member 700 and thus can freely bend, etc. The third wire member 800 can be a nylon coated stainless steel wire. Element 711 can represent a means for attaching the connector 710 to the second wire member 700.

A first end 802 of the third wire member 800 is attached to the connector 720 which thus connects the third wire member 800 to the second wire member 700. A second end 804 of the third wire member 800 is attached to the protrusion 612 of the tip rib 610. In this way, the third wire member 800 is attached to the first main canopy 110. It will be appreciated that the third wire member 800 can a colored wire due to colored nylon and in one embodiment, the third wire member 800 has a red color to differentiate what is otherwise a stainless-steel colored or black colored rib mechanism.

The rib assembly can be attached to the first and second canopies 110, 120 in the following manner.

The secondary canopy 120 is attached to the first rib member 220 as by passing an attached thread through hole 241 to anchor the secondary canopy 120 to the first rib member 220. At the inner edge of the first canopy 110 where the center opening is formed, the second canopy 120 can be anchored to the first canopy 110 as by a stitch (thread) which also captures the wire portion 300. This attachment point is located internal to the free end 302 of the wire portion 300 which once against is anchored to the peripheral outer edge of the second canopy 120 using a rib tip at end 302. Thus, the length of the wire portion 300 from the attachment point to the two canopies 110, 120 to the end 302 is not attached to the first canopy 110 and extends thereover and is freely flexible so as to counter inversion forces.

The rib joint member 500 has a hole 315 to which the first canopy 110 is attached as by using a thread that passes through the hole 315 with said thread being attached to the first canopy 110 so as to anchor the first canopy 110.

In addition, the third rib member 600 can be attached to the first canopy 110 using a thread or stitch so as to anchor the third rib member 600 to the first canopy 110.

According to one aspect of the present invention, the anti-inversion mechanism, defined by the wire members 300, 310, 700, 800 is provided and is configured to counter an inversion force that is applied to the umbrella during select operating conditions and in particular, during windy conditions or other adverse conditions. As is well known by users of umbrellas, if a sudden gust of wind is directed upwardly toward the inside of the umbrella, the pressure applied by the wind will invert the canopy causing the ribs to work counterproductively forcing it outwards. The canopy generally assumes a concave shape when inversion occurs and similarly, the ribs are forced to pivot in unintended directions which can result in one or more ribs breaking. This renders the umbrella not usable. The umbrella of the present invention has the anti-inversion mechanism that is made up of several components that are individually discussed above.

The wire/cable 800 can thus be thought of as being an anti-inversion wire that attaches the anti-inversion mechanism to the canopy tip 610 as disclosed herein. The cable 800 can be and preferable is in the form of a nylon coated stainless steel wire. However, other structures may also be suitable such as a Kevlar fiber or other types of high strength fibers.

The wire 700 can thus be configured such that it acts as an anti-inversion spring that applies a counteractive force to resist inversion of the umbrella as a result of a force (e.g., pressure) applied to the underside of the canopy. The anti-inversion spring (wire 700) thus applies a biasing force to maintain the rib assembly and in particular, the third rib part 600, etc., in a normal operating position. This biasing force thus counteracts upward movement of the third rib part 600 as a result on an applied inversion force (e.g., a sudden gust of wind directed upwardly). The strength of the wire 800 prevents the outer peripheral part of the canopy from inverting by lifting upward (which results in stress on the parts and likely breakage).

The ribs parts 220, 400, 600 can be formed of any number of different materials and it will be understood that according to the present invention, the ribs 220, 400, 600 can be formed of two or more different materials. For example, the rib parts 220, 400 can be formed of a metal, such as aluminum; however, in accordance with one aspect of the present invention, the rib part 600 can be formed of a carbon material (e.g., flutted carbon).

Figure 5:
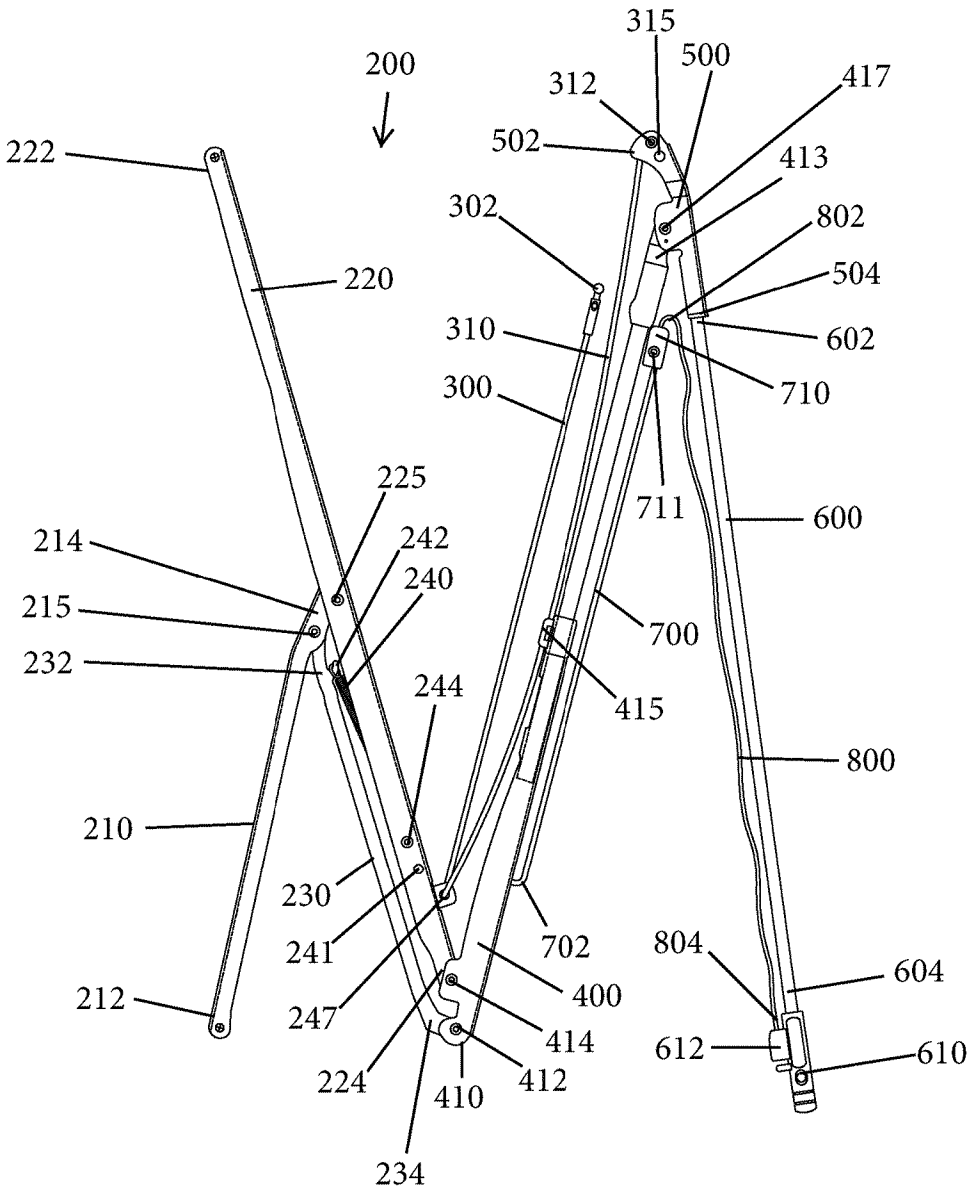
FIG. 5 is a side view of an anti-inversion mechanism.
Figure 6:
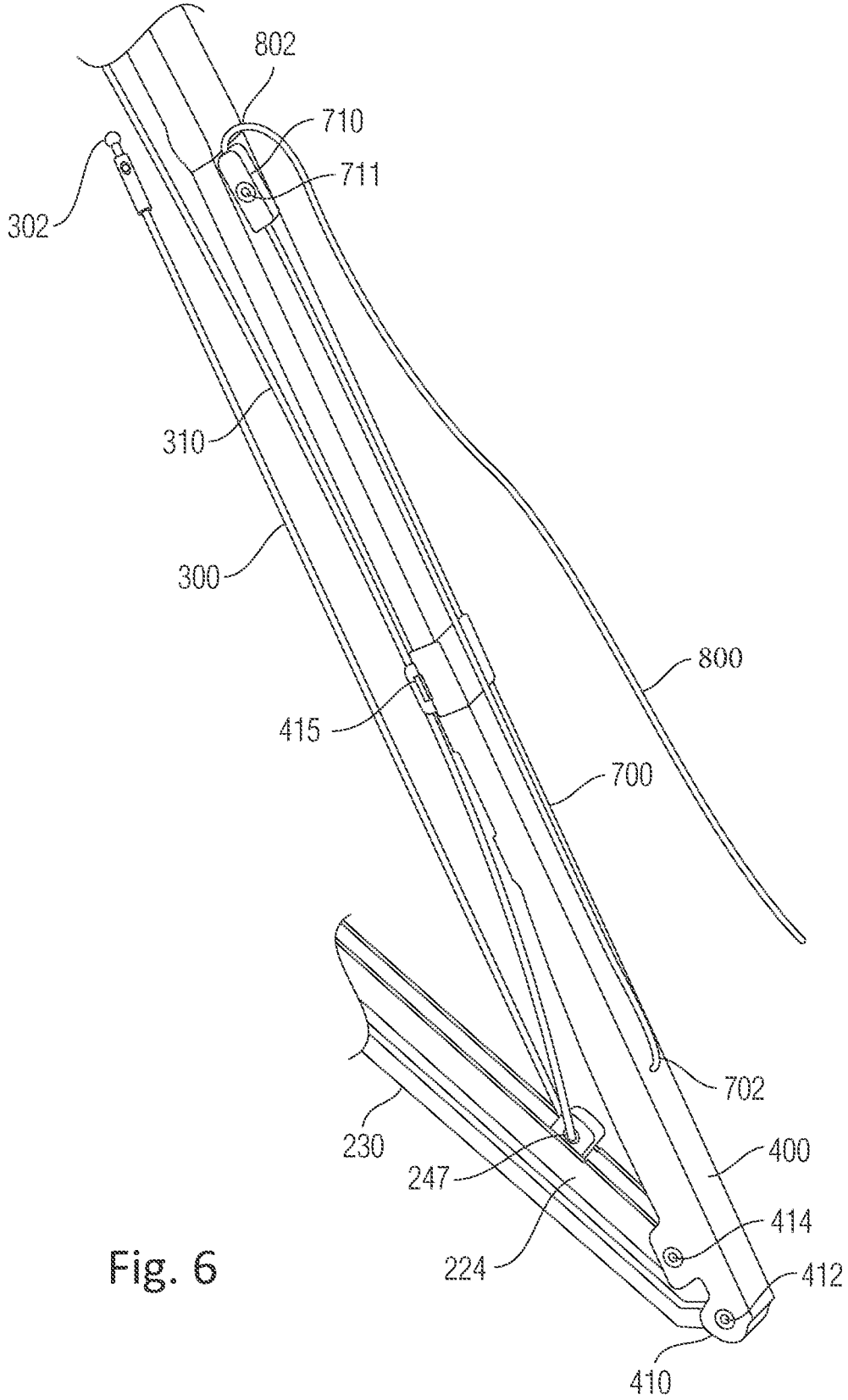
FIG. 6 is a close-up of a portion of the anti-inversion mechanism.

As shown in FIG. 5, in the collapsed state, the second wire member 700 is positioned proximate (adjacent and running parallel to) the second rib part 400. However, in the fully opened position, the free end of the second wire member 700 flexes downward from the second rib part 400 and is spaced therefrom and can act as a spring element that stores energy due to it being deflected downward and its cantilevered structure. Likewise, the third wire 800 in the closed state is adjacent and runs parallel to the third rib part 600 as shown; however, in the opened position, the wire 800 is pulled away from the third rib part 600 by the deflected wire member 700 and is thus under tension.

It will also be appreciated while the elements 300, 700, 800 are described as being wire members, these elements are not limited to being wire constructions and can be formed of many types of inelastic materials and can take various forms including a string, a wire, a ribbon, etc. These elements can be bendable but do not elongate under force (inelastic).

Figure 8:
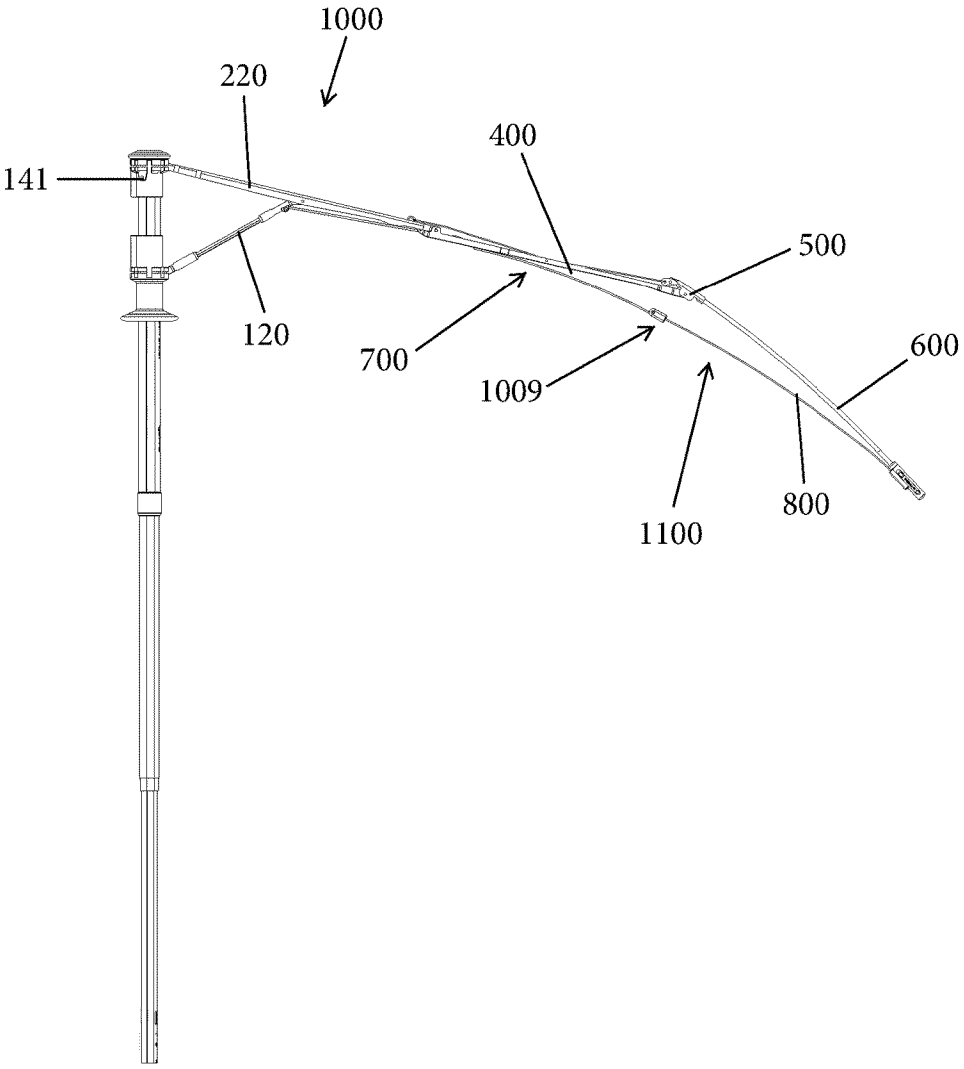
FIG. 8 is a side elevation view showing the runner and rib assembly in an extended position.
Figure 7:
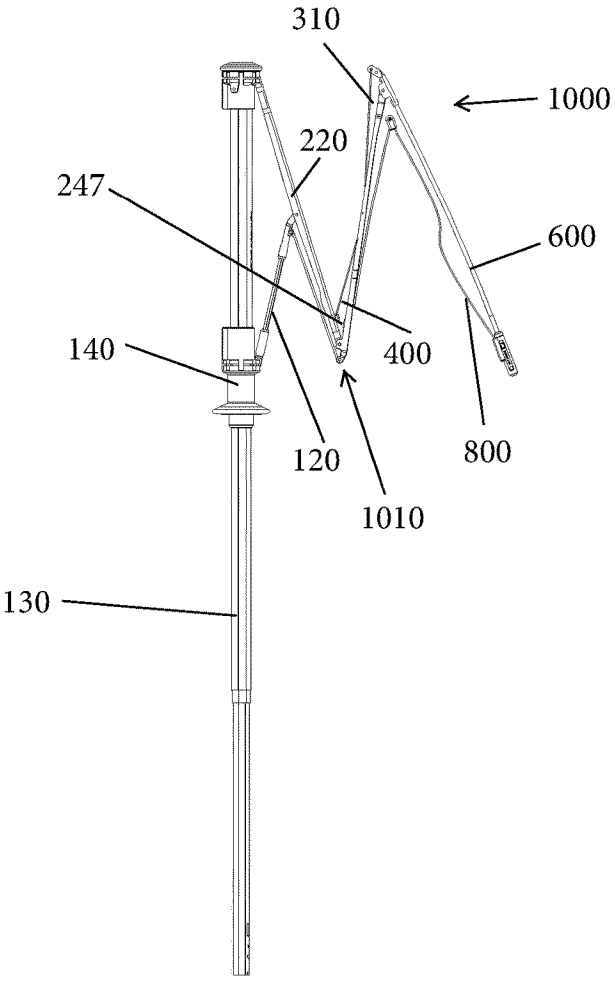
FIG. 7 is a side elevation view of a shaft, runner and rib assembly with an anti-inversion mechanism according to another embodiment without the canopies being shown and being shown in a partially collapsed position.
Figure 9:
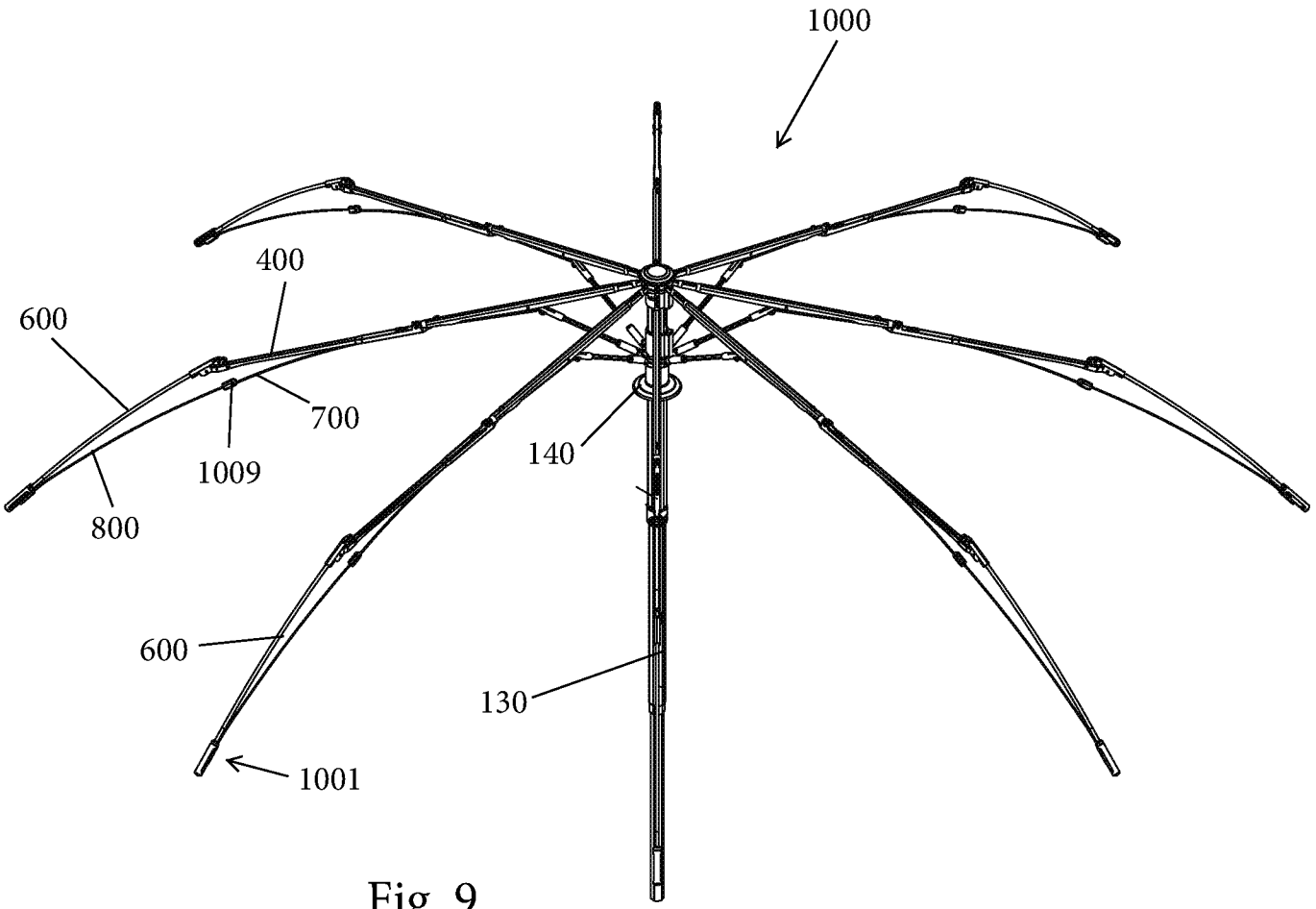
FIG. 9 is a top and side perspective view of the umbrella in the fully extended position.
Figure 12:
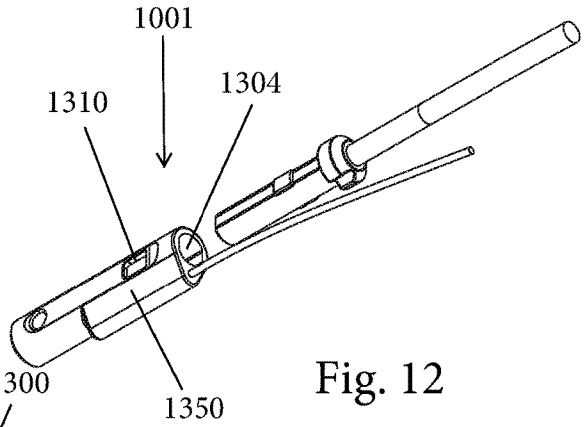
FIGS. 10-12 are exploded perspective views of a tip connector system that is part of the anti-inversion mechanism.
Figure 11:
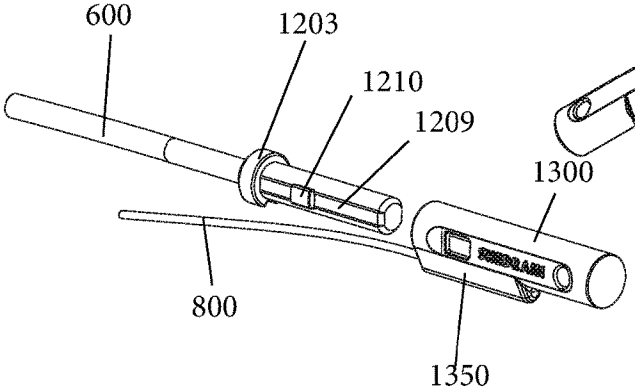
Figure 10:
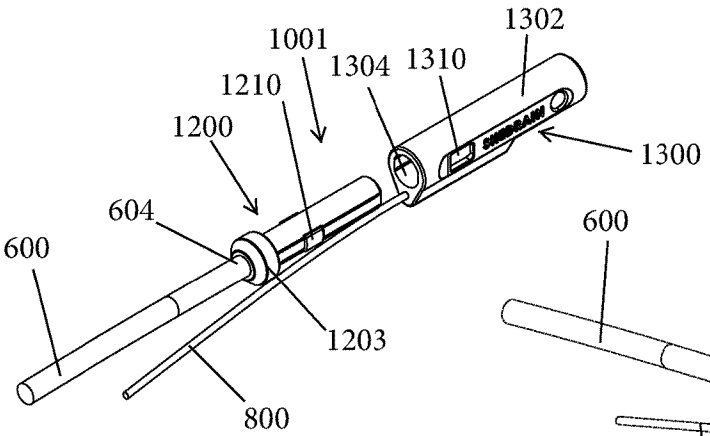

FIGS. 7-9 illustrate one exemplary umbrella 1000 in which an anti-inversion mechanism or system 1100 can be implemented. As with the embodiment of FIGS. 1-6, it will be appreciated that the embedment of FIGS. 7-9 is only one type of umbrella in which the system 1100 can be implemented and the system 1100 can be implemented in many different types of umbrellas.

The umbrella 1000 can be a single canopy type umbrella or can be a dual canopy design as shown in FIG. 1-6. Since the umbrella 1000 is similar to the umbrella 100, like elements are numbered alike. In particular, the umbrella 1000 can include many of the same parts as the umbrella 100 and therefore, the same figure legends are used to depict the same parts that in common to both umbrella 1000 and umbrella 100.

The umbrella 1000 includes a plurality of rib assemblies 1010 that are coupled to both the cap and the runner 140 and this results in the opening and closing of the rib assembly 1010 and the attached canopy (not shown) based on the direction of movement of the runner 140. As described herein, each rib assembly is defined by a number of rib parts that are pivotally attached to another to allow for the collapsing and extension of the rib assembly in response to opening and closing of the canopy by the runner 140.

Each rib assembly 1010 can be very similar to the construction of the rib assembly 200 with one difference being that the first wire member has a different construction to accommodate a single canopy of FIG. 7-9 versus the dual canopy design of FIGS. 1-6. In particular, the first wire portion 300 is eliminated while the second wire portion 310 is maintained. The second wire portion 310 is terminated at the coupling member 247 as opposed to being bent back to form the first wire portion 300 as in the first embodiment (FIGS. 1-6).

In addition, while umbrella 1000 is a three-rib type umbrella, it will be appreciated that the anti-inversion system 1100 is not limited to being implemented in a three rib type umbrella. Instead, the anti-inversion system 1100 can be implemented into a rib construction that has other than three total ribs. In the illustrated three rib type umbrella, the anti-inversion system 1100 is incorporated between the second and third ribs as shown and as described herein.

Anti-inversion system 1100 includes the first elongated member that includes second wire portion (a first elongated member) 310, a second elongated member and a third elongated member. It will be appreciated that the second elongated member can be the same or similar to the second wire member 700 and the third elongated member can be the same or similar to the third wire member 800. As discussed herein, each of these elements 310, 700, 800 is not limited to being a wire but instead can take many different forms, such as a wire, string, ribbon. This is especially the case with the first and third elongated members 310, 800.

One main difference between the umbrella 1000 and the umbrella 100 is the manner in which the third elongated member 800 is coupled to the third rib part 600. Once again, the below described coupling technique is not limited to the coupling of the third elongated member 800 to the third rib part 600 but generally is a manner for coupling the third elongated member 800 to any distal rib (e.g., in a two rib umbrella, the distal rib is the second rib). It will be appreciated that the manner of attachment that is described below can be implemented into the umbrella construction shown in FIGS. 1-6.

It will be appreciated that while the second rib part 400 can be in the form of a stamped metal rib, it can also take other forms, such as being an injection molded plastic or other material and therefore, is not limited to being a metal rib. The second elongated member 700 which can be a metal wire or rod that can flex is attached at a first end to the second rib part 400.

As shown, the second elongated member 700 is attached to the third elongated member 800 at respective ends thereof. In many embodiments, the second elongated member 700 and the third elongated member 800 are formed of different materials. For example, the second elongated member 700 can be in the form of a rigid, flexible metal rod or wire and the third elongated member 800 can be in the form of a thinner string or wire or cable.

In particular, as shown in FIG. 8, a connector 1009 can be used to connect the second elongated member 700 and the third elongated member 800. In one embodiment, the third elongated member 800 (string) can be overmolded into the connector 1009 to provide a secure connection between the third elongated member 800 and the connector 1009. The second end of the second elongated member 700 is attached to the connector 1009 and a first end of the third elongated member 800 is attached to the connector 1009. The connector 1009 thus can provide a means for coupling two different structures that are formed of two different materials.

The manner to attach the third elongated member 800 (e.g., wire or string or ribbon) to the third rib part 600 is best shown in FIGS. 10-15. More specifically, the umbrella 1000 includes a tip connection system 1001 that allows for the third elongated member 800 to be easily attached to the third rib part 600.

In general, a first connector 1200 (first coupling part) that is associated with the third elongated member 800 is mated to a second connector 1300 (second coupling part) that is associated with the third rib part 600 to attach the third elongated member 800 to the third rib part 600. As described herein, the attachment mechanism can be of a mechanical type in which a snap fit or the like can be formed between the third elongated member 800 and the third rib part 600.

More specifically, the first connector 1200 is provided for attachment to the distal end of the third rib part 600. The first connector 1200 is thus fixedly attached to the end of the third rib part 600 and similarly, the second connector 1300 is provided for attachment to the distal end of the third elongated member 800. The first coupling part 1200 can be considered to be an inner tip, while the second connector 1300 can be considered to be an outer tip. As described herein, the inner tip is configured to be received within the outer tip. The first connector 1200 can thus be considered to be a male part and the second connector 1300 can be considered to be a female part.

The first connector 1200 is thus located at the distal end 604 of the third rib part 600. The first connector 1200 can be a generally cylindrical part that caps off the distal end 604 of the third rib part 600. The first connector 1200 includes a pair of locking tabs (first locking element) 1210 that protrude outwardly along sides of the first connector 1200. For example, the locking tabs 1210 can be located opposite one another (180 degrees apart) along the sides of the first coupling part 1200. In the illustrated embodiment, the first connector 1200 has a pair of flats 1209 that are formed along the sides of the first connector 1200 and the two locking tabs 1210 are formed along these two flats 1209. Each of the locking tabs 1210 can have a rounded construction.

One end 1203 (a proximal end) of the first connector 1200 can be enlarged relative to the other section of the first connector 1200 and more specifically, the end 1203 can be an annular shaped flange that also acts as a stop as described herein. More specifically, once the first connector 1200 is received into the second connector 1300, the first connector 1200 is inserted until the flange 1203 seats against the open end of the second connector 1300.

As show, the first connector 1200 can completely cap the distal end 604 of the third rib part 600.

In one embodiment, the first connector 1200 can be attached to the distal end 604 using any number of conventional techniques including but not limited to overmolding the first connector 1200 over the distal end 604 or the first coupling part 1200 can be a previously manufactured part that is attached to the distal end 604 by means of a bonding agent (adhesive) or by other techniques.

The first connector 1200 can thus be considered to be a male part since it has a cap form at the end of the distal end 604.

The second connector 1300 is disposed at the distal end of the third elongated member 800 as shown. The second connector 1300 has a main portion 1302 that is in the form of a hollow cylindrical part with a hollow interior 1304 that is accessed at an open first end 1303 of the second connector 1300. An opposite second end 1305 is a closed end of the second connector 1300. Within the main portion 1302, a pair of openings or windows (second locking element) 1310 are formed. In particular, the spacing and locations of the windows 1310 are complementary to the locations and spacings of the locking tabs 1210 since the locking tabs 1210 are slidingly received within the windows 1310 to cause a secure coupling between the two connectors 1200, 1300. Thus, the axial length of the hollow interior 1304 is selected in view of the axial (longitudinal) length of the first connector 1200 so that when the first connector 1200 is received within the hollow interior 1304, the distal end of the first connector 1200 abuts the distal end of the hollow interior 1304. At the same time, the locking tabs 1210 enter into the windows 1310 to effectively couple the first connector 1200 to the second connector 1300. In other words, the reception of the locking tabs 1210 into the windows 1310 can be of a snap-fit type coupling and more particularly, is a one-way, irreversible type coupling in that it is not intended for the first connector 1200 to be disengaged from the second connector 1300. The mating between the two connectors 1200, 1300 can be considered to be a clipping type action.

The second connector 1300 also includes an extension 1350 that is integral to and extends outwardly from the main portion 1302. The extension 1350 extends longitudinally along a section (a length) of the main portion 1302. The extension 1350 serves as an anchor for the third elongated member 800 in that a distal end of the third elongated member 800 is securely attached to the extension 1350. The extension 1350 is spaced from the hollow interior 1304 to effectively locate and position the third elongated member 800 away from the hollow interior 1304 since the third elongated member 800 cannot interfere with the reception of the first coupling part 1200 into the second coupling part 1300.

The distal end of the third elongated member 800 is secured to the extension 1350 using any number of suitable techniques. For example, the distal end can be anchored by an overmold process in which the extension 1350 (and the entire second connector 1300 for that matter) is formed around the third elongated member 800 by an overmold process. The extension 1350 can be considered to be along an underside of the second connector 1300.

Other techniques, such as use of a bonding agent, can be used to anchor the third elongated member 800 to the extension 1350.

Figure 15:
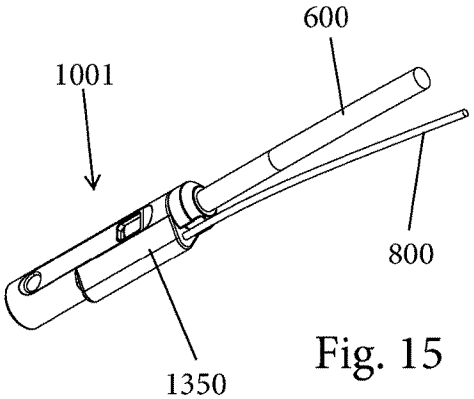
FIGS. 13-15 are perspective views of the tip connector system in an assembled condition.
Figure 13:
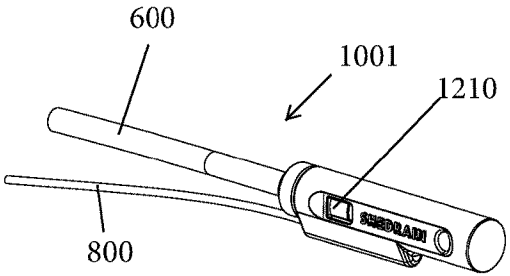
Figure 14:
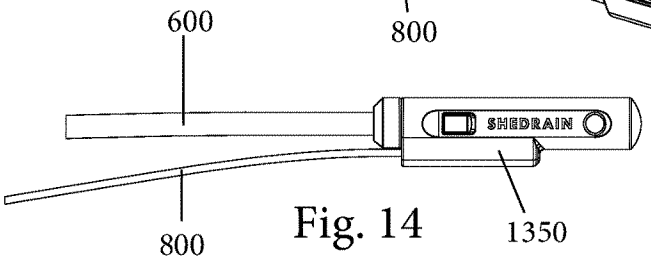

FIGS. 13-15 illustrate the first and second connectors (inner/outer tips) 1200, 1300 in the assembled condition with the first coupling part (inner tip) 1200 being fully received within the hollow interior 1304 of the second connector 1300. As mentioned, the locking between the two connectors 1200, 1300 occurs due to the locking tabs being received into the windows.

The leading edge of the locking tab 1210 can be a beveled edge to allow reception of the locking tabs 1210 into the windows 1310. The beveled edge allows for the flexing of the second connector 1300 to allow passage of the first connector 1200 into the hollow interior 1304 and since the tabs 1210 define the widest part of the first connector 1200, once the tabs 1210 are received into the windows 1310 any flexing is released.

The present tip connection system 1001 is thus configured to provide a means for coupling the third elongated member 800 (string, wire, ribbon) to the distal end of a rib, in this case the third rib part 600. By using two connector pieces, a simple, yet effective, connection can be established between the third elongated member 800 and the third rib part 600. In this way, the anti-inversion mechanism can be easily incorporated into the umbrella design and the attachment between the anti-inversion mechanism and the rib assembly can be achieved by the tip connection system 1001.

It will also be appreciated that it is possible to construct the tip connection system 1001 such that the first connector 1200 is associated with the third elongated member 800 and the second connector 1300 is associated with the rib 600.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An umbrella comprising:

an elongated shaft having a first end and an opposite second end;

a runner slidably disposed about the elongated shaft; and a plurality of rib assemblies, each rib assembly including a plurality of ribs including a distal rib, the rib assembly being attached to the runner by a strut that moves between open and closed positions in which in the open position, the plurality of ribs are in an open, extended position and in the closed position, the plurality of ribs are in a closed, collapsed position;

an anti-inversion mechanism that is configured to apply to each rib assembly a force that counters an inversion force that is applied to the umbrella, the anti-inversion mechanism including a first elongated member that is coupled at a first end to one rib of the plurality of ribs;

a second elongated member having a first end coupled to the first elongated member;

a first connector that is coupled to a distal end of the distal rib; and a second connector that is coupled to a second end of the first elongated member, the second connector being a hollow structure that receives the first connector such that the second connector surrounds the first connector, wherein the first connector and the second connector are coupled to one another by an irreversible snap-fit to securely attach the first elongated member to the distal rib.

2. The umbrella of claim 1, wherein the second elongated member comprises a metal wire and the first second elongated member comprises a string.

3. The umbrella of claim 1, wherein the plurality of ribs comprises a first rib, a second rib, and a third rib that comprises the distal rib, the second elongated member comprising a rigid metal wire with the first end of the second elongated member being coupled to the second rib and the first elongated member comprises a string.

4. The umbrella of claim 3, wherein the string is formed of a metal or a polymeric material.

5. The umbrella of claim 3, further including a third connector for attaching the first elongated member to the second elongated member.

6. The umbrella of claim 5, wherein the third connector comprises a molded structure with the second elongated member being embedded into the molded structure by an overmold process.

7. The umbrella of claim 1, wherein the first connector comprises a male part and the second connector comprises a female with the male part being snap-fittingly received within the female part.

8. The umbrella of claim 7, wherein the first connector includes at least one locking tab that is received within at least one window formed in the second connector to securely attach the first connector to the second connector.

9. The umbrella of claim 8, wherein the first connector includes a pair of locking tabs and the second connector includes a pair of windows that receive the locking tabs.

10. The umbrella of claim 1, wherein the first connector comprises a plastic part that surrounds the distal end of the distal rib which is embedded within the plastic part by an overmold process.

11. The umbrella of claim 10, wherein the plastic part includes an enlarged end that seats against an open end of the second connector when the first and second connectors are coupled to one another.

12. The umbrella of claim 1, wherein the second connector comprises a plastic that has a hollow main portion with an open first end and an opposite closed second end, the hollow main portion receiving the first connector, the second connector further including an integral extension that protrudes outwardly from a side wall of the hollow main portion, the second elongated member being coupled to the extension.

13. The umbrella of claim 12, wherein the second elongated member comprises a string that is embedded within the extension by an overmold process.

14. The umbrella of claim 1, wherein the first elongated member is disposed exteriorly along the one rib and has a first bent end that is attached to the one rib by passing through an opening formed in the one rib and being anchored within a hollow interior of the one rib.

15. The umbrella of claim 1, wherein the first connector is coupled to the second connector by an irreversible snap-fit defined by locking tabs, that are formed along the first connector, being received within windows that are formed along the second connector.

16. An umbrella comprising:

an elongated shaft having a first end and an opposite second end;

a runner slidably disposed about the elongated shaft; and a plurality of rib assemblies, each rib assembly including a plurality of ribs including a distal rib, the rib assembly being attached to the runner by a strut that moves between open and closed positions in which in the open position, the plurality of ribs are in an open, extended position and in the closed position, the plurality of ribs are in a closed, collapsed position;

an anti-inversion mechanism that is configured to apply to each rib assembly to a force that counters an inversion force that is applied to the umbrella, the anti-inversion mechanism including a first elongated member that is coupled at a first end to one rib of the plurality of ribs;

a second elongated member having a first end coupled to the first elongated member;

an inner tip that is coupled to a distal end of the distal rib and includes a male first locking element; and a hollow outer tip that is coupled to a second end of the first elongated member and includes a female locking element, wherein the inner tip is received within the hollow outer tip and the male locking element interlockingly engages the female locking element to securely attach the second elongated member to the distal rib;

wherein the distal end of the distal rib is embedded within the inner tip and the second elongated member is embedded within the hollow outer tip.

17. The umbrella of claim 16, wherein the first elongated member comprises one of a rigid metal structure and a rigid plastic structure and the second elongated member comprises one of a wire, cable and string.

18. The umbrella of claim 16, wherein the second elongated member is embedded at a location that is laterally offset from an entrance into the hollow outer tip so as to not interfere with reception of the inner tip within the hollow outer tip.

19. The umbrella of claim 16, wherein the male locking element comprises a pair of locking tabs and the female locking element comprises a pair of windows that are configured to receive the pair of tabs for locking the inner tip relative to the hollow outer tip.

* * * * *